US008301046B2

(12) United States Patent
Furukawa et al.

(10) Patent No.: US 8,301,046 B2
(45) Date of Patent: Oct. 30, 2012

(54) IMAGE FORMING APPARATUS WITH CONDITION SETTING FOR MANUAL DUPLEX MODE

(75) Inventors: Toshio Furukawa, Nagoya (JP); Katsuyuki Yokoi, Iwakura (JP); Kensuke Miyahara, Hekinan (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/216,728

(22) Filed: Aug. 24, 2011

(65) Prior Publication Data

US 2011/0305470 A1 Dec. 15, 2011

Related U.S. Application Data

(63) Continuation of application No. 11/777,662, filed on Jul. 13, 2007, now Pat. No. 8,027,606.

(30) Foreign Application Priority Data

Jul. 19, 2006 (JP) ..... 2006-196916

(51) Int. Cl.
*G03G 15/00* (2006.01)

(52) U.S. Cl. ..... 399/43; 399/44

(58) Field of Classification Search ..... 399/43, 399/44, 45, 55, 66, 309, 364, 401
See application file for complete search history.

(56) References Cited

U.S. PATENT DOCUMENTS 5,784,668 A * 7/1998 Hyakutake et al. ..... 399/55
6,192,204 B1 2/2001 Yagi et al.
2004/0052539 A1* 3/2004 Shim et al. ..... 399/45
2006/0083568 A1 4/2006 Takahashi
2006/0133844 A1* 6/2006 Konno ..... 399/82
2008/0019715 A1 1/2008 Furukawa et al.

FOREIGN PATENT DOCUMENTS

| | | |
|---|---|---|
| JP | 63-301363 | 12/1988 |
| JP | 2273771 | 11/1990 |
| JP | 3131885 | 6/1991 |
| JP | 4275583 | 10/1992 |
| JP | 06-230660 | 8/1994 |
| JP | 9244434 | 9/1997 |
| JP | 2000267541 | 9/2000 |
| JP | 2001083751 | 3/2001 |
| JP | 2001089040 | 4/2001 |
| JP | 2003015440 | 1/2003 |
| JP | 2003345182 | 12/2003 |
| JP | 2005134587 | 5/2005 |
| JP | 2006027042 | 2/2006 |

OTHER PUBLICATIONS

Notice of Reasons for Refusal issued Feb. 17, 2011, in corresponding Japanese Patent Application No. 2006-196916 and partial English translation thereof.

* cited by examiner

*Primary Examiner* — Walter L Lindsay, Jr.
*Assistant Examiner* — Billy J Lactaoen
(74) *Attorney, Agent, or Firm* — Banner & Witcoff, Ltd.

(57) ABSTRACT

Provided is an image forming apparatus including an image forming section forming images on image forming faces of a recording medium, a condition setting section individually setting an operating condition of the image forming section for forming the image on a first image forming face of a recording medium and another operating condition of the image forming section for forming the image on a second image forming face of the recording medium opposite to the first image forming face in the manual duplex mode, and a control section controlling the image forming section on the basis of each operating condition set by the condition setting section.

8 Claims, 15 Drawing Sheets

FIG. 7A

| | | SX | | | MDX2 | | | MDX1 | | |
|---|---|---|---|---|---|---|---|---|---|---|
| | | WIDTH | | | WIDTH | | | WIDTH | | |
| | | -120 | 120—170 | 170— | -120 | 120—170 | 170— | -120 | 120—170 | 170— |
| THICKNESS | THIN | 2 | 2 | 1 | 3 | 2 | 1 | 4 | 3 | 2 |
| | ORDINARY | 2 | 1 | 1 | 3 | 2 | 1 | 4 | 3 | 2 |
| | THICK | 11 | 11 | 11 | 12 | 11 | 11 | 13 | 12 | 11 |

FIG. 7B

| | K | Y | M | C |
|---|---|---|---|---|
| 1 | 9 | 10 | 11 | 12 |
| 2 | 10 | 11 | 12 | 13 |
| 3 | 11 | 12 | 13 | 15 |
| 4 | 12 | 13 | 15 | 17 |
| 11 | 5 | 5 | 6 | 7 |
| 12 | 6 | 6 | 7 | 8 |
| 13 | 7 | 7 | 8 | 9 |

FIG. 8A

| | | SX | | | MDX2 | | | MDX1 | | |
|---|---|---|---|---|---|---|---|---|---|---|
| | | WIDTH | | | WIDTH | | | WIDTH | | |
| | | -120 | 120—170 | 170— | -120 | 120—170 | 170— | -120 | 120—170 | 170— |
| THICKNESS | THIN | 2 | 1 | 1 | 2 | 2 | 1 | 2 | 2 | 1 |
| | ORDINARY | 1 | 1 | 1 | 2 | 1 | 1 | 2 | 2 | 1 |
| | THICK | 11 | 11 | 11 | 12 | 11 | 11 | 12 | 12 | 11 |

FIG. 8B

| | K | Y | M | C |
|---|---|---|---|---|
| 1 | 9 | 10 | 11 | 12 |
| 2 | 10 | 11 | 12 | 13 |
| 3 | 11 | 12 | 13 | 15 |
| 4 | 12 | 13 | 15 | 17 |
| 11 | 5 | 5 | 6 | 7 |
| 12 | 6 | 6 | 7 | 8 |
| 13 | 7 | 7 | 8 | 9 |

FIG. 9A

| | | SX | | | MDX2 | | | MDX1 | | |
|---|---|---|---|---|---|---|---|---|---|---|
| | | WIDTH | | | WIDTH | | | WIDTH | | |
| | | -120 | 120—170 | 170— | -120 | 120—170 | 170— | -120 | 120—170 | 170— |
| THICKNESS | THIN | 3 | 3 | 3 | 3 | 3 | 3 | 4 | 3 | 3 |
| | ORDINARY | 2 | 3 | 3 | 3 | 3 | 3 | 3 | 3 | 3 |
| | THICK | 11 | 12 | 13 | 12 | 13 | 13 | 13 | 13 | 13 |

FIG. 9B

| | K | Y | M | C |
|---|---|---|---|---|
| 1 | 7 | 8 | 9 | 10 |
| 2 | 8 | 9 | 10 | 11 |
| 3 | 9 | 10 | 11 | 12 |
| 4 | 10 | 11 | 12 | 13 |
| 11 | 3 | 3 | 4 | 5 |
| 12 | 4 | 4 | 5 | 6 |
| 13 | 5 | 5 | 6 | 7 |

FIG. 10A

| | | SX | | | MDX2 | | | MDX1 | | |
|---|---|---|---|---|---|---|---|---|---|---|
| | | WIDTH | | | WIDTH | | | WIDTH | | |
| | | -120 | 120—170 | 170— | -120 | 120—170 | 170— | -120 | 120—170 | 170— |
| THICKNESS | THIN | 1 | 2 | 3 | 5 | 6 | 6 | 7 | 7 | 7 |
| | ORDINARY | 1 | 2 | 3 | 5 | 5 | 6 | 7 | 7 | 7 |
| | THICK | 11 | 12 | 13 | 14 | 14 | 15 | 16 | 16 | 16 |

FIG. 10B

| | K | Y | M | C |
|---|---|---|---|---|
| 1 | 9 | 8 | 9 | 12 |
| 2 | 10 | 9 | 10 | 13 |
| 3 | 11 | 10 | 11 | 14 |
| 4 | 12 | 11 | 13 | 17 |
| 5 | 9 | 9 | 10 | 12 |
| 6 | 10 | 10 | 11 | 13 |
| 7 | 9 | 10 | 11 | 12 |
| 11 | 5 | 3 | 4 | 7 |
| 12 | 6 | 4 | 5 | 8 |
| 13 | 7 | 5 | 6 | 9 |
| 14 | 4 | 3 | 4 | 6 |
| 15 | 5 | 4 | 5 | 7 |
| 16 | 5 | 5 | 6 | 7 |

IMAGE FORMING APPARATUS WITH CONDITION SETTING FOR MANUAL DUPLEX MODE

CROSS REFERENCE TO RELATED APPLICATIONS

This application claims priority to U.S. application Ser. No. 11/777,662, filed on Sep. 13, 2007, which claims priority to Japanese Patent Application No. 2006-196916, filed on Jul. 19, 2006, the disclosures of which are hereby incorporated by reference into the present application by reference.

TECHNICAL FIELD

The present invention relates to an image forming apparatus such as a laser printer.

BACKGROUND

An image forming apparatus such as a laser printer includes a photosensitive drum and a transfer roller opposed thereto, for example. An electrostatic latent image corresponding to an image to be formed on a sheet is formed on the surface of the photosensitive drum. A toner is fed to the electrostatic latent image, so that a toner image is carried on the surface of the photosensitive drum. When the photosensitive drum is rotated so as to oppose the toner image to the sheet transported between the photosensitive drum and the transfer roller on a position facing the transfer roller, the toner image is transferred from the surface of the photosensitive drum to the sheet due to the action of a transferring bias supplied to the transfer roller. Thereafter the sheet is heated and pressurized, so that the toner image is fixed to the sheet, thereby forming the image on the sheet.

In relation to such an image forming apparatus, there has been provided an apparatus having a so-called automatic duplex mode for forming an image on a first face of a sheet and thereafter inverting and transporting the sheet for forming another image on a second face of the sheet opposite to the first face.

In this automatic duplex mode, the image is formed on the second face of the sheet immediately after the formation of the image on the first face, whereby the sheet exhibits different electric resistances in the image formation on the first face and that on the second face. In other words, the sheet having the image formed on the first sheet is dried due to heating for fixing the toner image thereto, so that it exhibits a higher electric resistance than that before the image formation. In order to transfer the toner image onto the second face of the sheet in an excellent state, therefore, a transferring bias for the image formation on the second face of the sheet must be higher than that for the image formation on the first face. There have been proposed some methods of controlling transferring biases in such an automatic duplex mode.

Conventional image forming apparatuses include that having the so-called manual duplex mode where an image is formed on a first face of a sheet and the sheet is ejected onto a sheet ejection tray and then the user sets the ejected sheet on a sheet feeding tray and starts image formation on a second face of the sheet.

In this manual duplex mode, however, no control is performed for attaining excellent image formation on the second face of the sheet, dissimilarly to the aforementioned automatic duplex mode controlling the transferring biases. Further, there has been no proposal related to such control at present.

SUMMARY

Accordingly, an object of the present invention is to provide an image forming apparatus capable of forming excellent images on both faces (first and second image forming faces) of a recording medium in a manual duplex mode.

One aspect of the present invention may provide an image forming apparatus including: an image forming section forming an image on an image forming face of a recording medium; a recording medium feeding section set with the recording medium to be fed to the image forming section; and a recording medium ejecting section receiving the recording medium formed with the image in the image forming section, and having a manual duplex mode for setting a recording medium formed with an image on a first image forming face and ejected to the recording medium ejecting section on the recording medium feeding section and forming another image on a second image forming face of the recording medium opposite to the first image forming face, and the image forming apparatus further includes: a condition setting section individually setting an operating condition of the image forming section for forming the image on the first image forming face and another operating condition of the image forming section for forming the image on the second image forming face in the manual duplex mode; and a control section controlling the image forming section on the basis of each operating condition set by the condition setting section.

BRIEF DESCRIPTION OF THE DRAWINGS

FIG. 7A illustrates an example of environment table used in the transferring bias setting shown in FIG. 5.

FIG. 7B illustrates an example of transferring bias table associated with the environment table shown in FIG. 7A.

FIG. 8A illustrates another example of the environment table used in the transferring bias setting shown in FIG. 5.

FIG. 8B illustrates an example of transferring bias table associated with the environment table shown in FIG. 8A.

FIG. 9A illustrates still another example of the environment table used in the transferring bias setting shown in FIG. 5.

FIG. 9B illustrates still an example of transferring bias table associated with the environment table shown in FIG. 9A.

FIG. 10A illustrates a further example of the environment table used in the transferring bias setting portion shown in FIG. 5.

FIG. 10B illustrates an example of the transferring bias table associated with the environment table shown in FIG. 10A.

DETAILED DESCRIPTION

Embodiments of the present invention are now described with reference to the drawings.

First Embodiment

1. General Structure of Color Laser Printer

Figure 1:
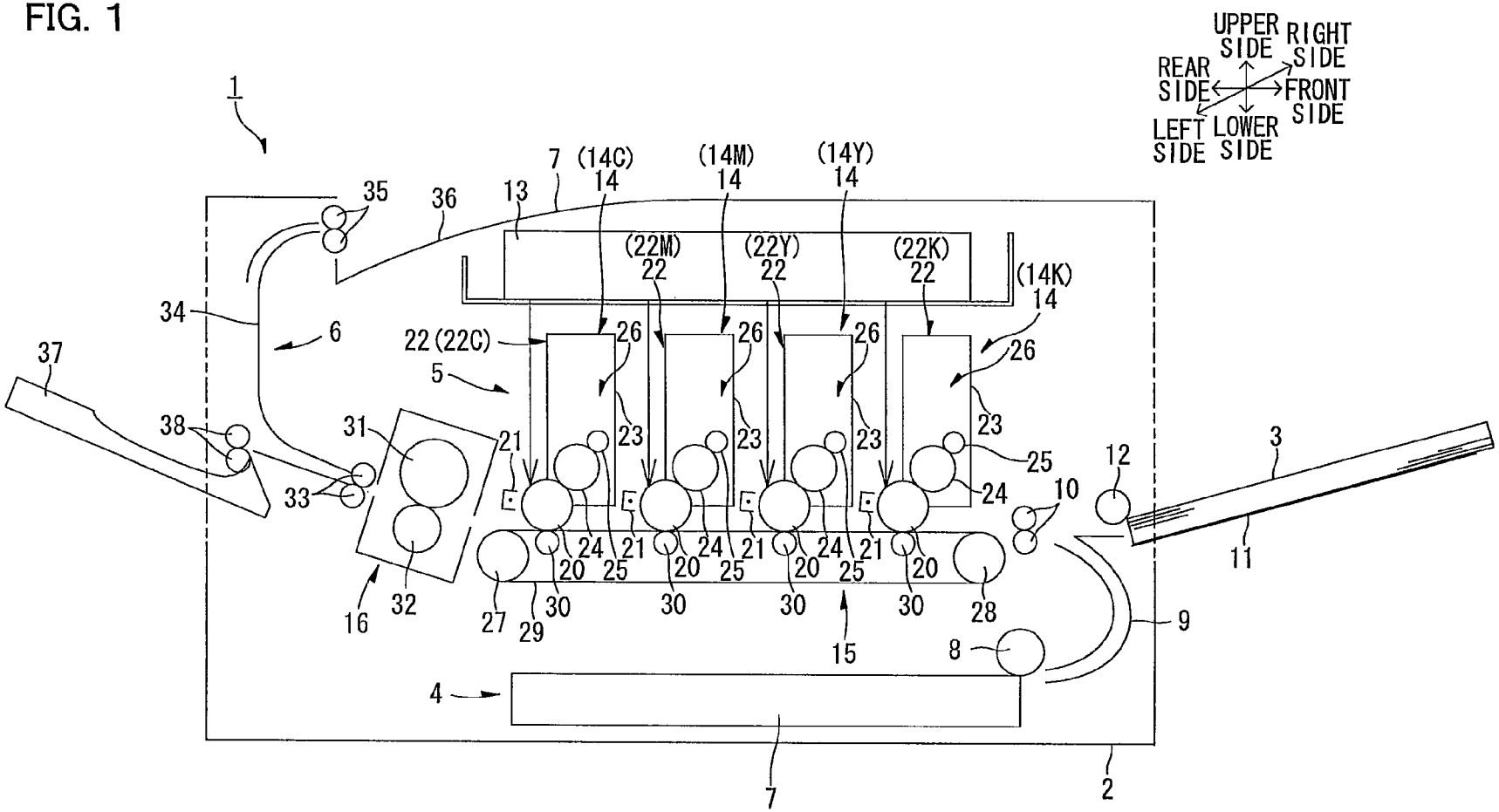
FIG. 1 is a side sectional view showing an embodiment of a color laser printer as an example of image forming apparatus according to the present invention.

FIG. 1 is a side sectional view showing an embodiment of a color laser printer as an example of image forming apparatus according to the present invention.

This color laser printer 1 is a tandem-type color laser printer having a plurality of processing sections 14, described later, horizontally arranged in parallel with one another. The color laser printer 1 includes a sheet feeding section 4 for feeding sheets 3 each serving as an example of recording medium, an image forming section 5 for forming an image on the fed sheet 3 and a sheet ejecting section 6 for ejecting the sheets 3 formed with the image, in a boxy main body casing 2.

In the following description, it is assumed that the side of the color laser printer 1 provided with a multipurpose tray 11 described later is the "front side" and the side opposite thereto is the "rear side".

(1) Sheet Feeding Section

The sheet feeding section 4 includes a sheet feeding cassette 7 provided on the inner bottom portion of the main body casing 2 as an example of recording medium feeding section, a sheet feeding roller 8 provided on the upper portion of the front end portion of the sheet feeding cassette 7, a sheet feeding path 9 provided in front of the sheet feeding roller 8 so that an end thereof is arranged in the vicinity of the sheet feeding roller 8, and a pair of resist rollers 10 provided in the vicinity of the other end of the sheet feeding path 9.

The sheet feeding cassette 7 accommodates the sheets 3 in a stacked state. When the sheet feeding roller 8 is rotated, the uppermost sheet 3 is delivered from the sheet feeding cassette 7 to the sheet feeding path 9. The sheet feeding path 9 has a generally C shape opening rearward. The transport direction for the sheet 3 delivered to this sheet feeding path 9 is anteroposteriorly reversed in the process of transportation along the sheet feeding path 9, and the face of the sheet 3 having been downwardly directed in the sheet feeding cassette 7 is turned over. Then, the sheet 3 is subjected to registration by the resist rollers 10, and thereafter fed rearward by the resist rollers 10.

The sheet feeding section 4 further includes the multipurpose tray 11 serving as an example of recording medium feeding section employed for manual sheet feeding or the like and a multipurpose-side sheet feeding roller 12 for feeding sheets 3 stacked on the multipurpose tray 11.

When the multipurpose-side sheet feeding roller 12 is rotated, the uppermost sheet 3 on the multipurpose tray (MP tray) 11 is delivered rearward. This delivered sheet 3 is transported while keeping upward the face having been upwardly directed on the multipurpose tray 11, subjected to registration by the resist rollers 10, and thereafter fed rearward by the resist rollers 10.

(2) Image Forming Section

The image forming section 5 includes a scanner unit 13, processing sections 14, a transferring section 15 and a fixing section 16.

(2-1) Scanner Unit

The scanner unit 13 is arranged above the plurality of processing sections 14 described later in an upper portion of the main body casing 2. Optical members such as four light sources, a polygonal mirror, an fθ lens, a reflecting mirror and a face tangle error correcting lens are arranged in this scanner unit 13. Laser beams emitted from the light sources on the basis of image data are deflected and scanned by the polygonal mirror, pass through the fθ lens and the face tangle error correcting lens, are reflected by the reflecting mirror and thereafter applied onto the surfaces of later-described photosensitive drums 20 for respective colors of the processing sections 14 through high-speed scanning.

(2-2) Processing Section

The plurality of processing sections 14 are provided corresponding to toners of a plurality of colors. In other words, the processing sections 14 include four sections, i.e. a black processing section 14K, a yellow processing section 14Y, a magenta processing section 14M and a cyan processing section 14C. The black, yellow, magenta and cyan processing sections 14K, 14Y, 14M and 14C are parallelly arranged in this order at intervals from the front side toward the rear side.

Each processing section 14 includes a photosensitive drum 20 serving as an example of image carrier, a scorotron charger 21 and a developing cartridge 22.

The photosensitive drum 20 is formed by a cylindrical positively chargeable photosensitive layer having an outermost layer of polycarbonate or the like. This photosensitive drum 20 is rotationally driven in image formation in the same direction (clockwise in FIG. 1) as that of movement of a transport belt 29 described later on a position in contact with the transport belt 29.

The scorotron charger 21 is a positively chargeable scorotron charger including a wire and a grid for generating corona discharge through application of a charging bias. This scorotron charger 21 is opposed to the photosensitive drum 20 at the back thereof at an interval so as not to come into contact with the photosensitive drum 20.

The developing cartridge 22 is arranged in front of the photosensitive drum 20. This developing cartridge 22 includes in a casing 23 thereof a developing roller 24 serving as an example of developer feeder and a feed roller 25 for feeding the corresponding toner to the developing roller 24.

The casing 23 is in the form of a box having an open lower end in the rear side thereof. A toner accommodation chamber 26 is formed in the upper portion of the casing 23. This toner accommodation chamber 26 accommodates the toner of the corresponding color. In other words, the toner accommodation chambers 26 of the yellow, magenta, cyan and black processing sections 14Y, 14M, 14C and 14K accommodate yellow, magenta, cyan and black toners, respectively. The yellow, magenta, cyan and black toners are prepared from positively chargeable nonmagnetic single-component polymerized toners blended with coloring agents of yellow, magenta, cyan and black respectively.

The developing roller 24 is opposed to the photosensitive drum 20 from the front side, and is in pressure contact with the photosensitive drum 20. This developing roller 24 is formed by covering a roller shaft of a metal with a roller portion formed of an elastic member such as a conductive rubber material or the like.

The feed roller 25 is opposed to the developing roller 24 from the front side, and is in pressure contact with the developing roller 24. This feed roller 25 is formed by covering a roller shaft of a metal with a roller portion formed of a conductive sponge member. In image formation, the feed roller 25 is rotationally driven in the same direction (counterclockwise in FIG. 1) as the developing roller 24.

In image formation (development), the developing roller 24 and the feed roller 25 are rotationally driven in the reverse direction (counterclockwise in FIG. 1) to the photosensitive drum 20 so that the roller portions thereof rub together. A developing bias is supplied to the developing roller 24, so that the positively charged toner is carried on the surface of the developing roller 24.

On the other hand, the photosensitive drum 20 is rotationally driven, so that the surface thereof is uniformly positively charged through the corona discharge from the scorotron charger 21. The positively charged portion is selectively exposed through high-speed scanning with the laser beams from the scanner unit 13. Thus, an electrostatic latent image of each color corresponding to an image to be formed on the sheet 3 is formed on the surface of the photosensitive drum 20. When this electrostatic latent image is opposed to the surface of the developing roller 24 by the rotation of the photosensitive drum 20, the toner carried on the developing roller 24 is transferred to the portion of the surface of the photosensitive drum 20 reduced in potential due to the exposure to the laser beams. Thus, the electrostatic latent image on the photosensitive drum 20 is visualized, so that a toner image corresponding to each color is carried on the surface of the photosensitive drum 20.

(2-3) Transferring Section

The transferring section 15 is anteroposteriorly arranged above the sheet cassette 7 and under the processing sections 14 in the main body casing 2. This transferring section 15 includes a driving roller 27, a driven roller 28, a transport belt 29 and transfer rollers 30 serving as example of transfer members.

The driving roller 27 is arranged rearward and downward of the photosensitive drum 20 of the cyan processing section 14C. This driving roller 27 is rotationally driven in the reverse direction (counterclockwise in FIG. 1) to the rotational direction of the photosensitive drum 20 in image formation.

The driven roller 28 is arranged frontward and downward of the photosensitive drum 20 of the black processing section 14K so as to be anteroposteriorly opposed to the driving roller 27. This driven roller 28 is driven and rotated in the same direction (counterclockwise in FIG. 1) as the rotational direction of the driving roller 27 during the rotation of the driving roller 27.

The transport belt 29 is an endless belt of resin such as conductive polycarbonate or polyimide in which conductive particles of carbon or the like are dispersed. This transport belt 29 is wound around the driving roller 27 and the driven roller 28, and arranged so that the outer contact surface thereof oppositely comes into contact with all photosensitive drums 20 of the processing sections 14.

The driving roller 27 drives the transport belt 29 to circumferentially move between the driving roller 27 and the driven roller 28 counterclockwise in FIG. 1 so as to move in the same direction as the photosensitive drums 20 of the processing sections 14 on the contact surfaces oppositely in contact with the photosensitive drums 20.

The transfer rollers 30 are arranged inside the transport belt 29 wound around the driving roller 27 and the driven roller 28, to be opposed to the photosensitive drums 20 of the processing sections 14 with the transport belt 29 sandwiched therebetween. Each transfer roller 30 is formed by covering a roller shaft of a metal with a roller portion formed of an elastic member such as a conductive rubber material or the like. The roller shaft of the transfer roller 30 extends along the width direction and is rotatably supported, and a transferring bias is applied thereto in transfer. The transfer roller 30 is rotated in the same direction (counterclockwise in FIG. 1) as the direction of the circumferential movement of the transport belt 29 on the contact surface oppositely in contact with the transport belt 29.

Each sheet 3 fed from the sheet feeding section 4 is transported by the transport belt 29 circumferentially moved by the driving roller 27 and the driven roller 28, to successively pass through image forming positions between the transport belt 29 and the photosensitive drums 20 of the processing sections 14 from the front side toward the rear side. During this transportation, the toner images corresponding to the respective colors carried on the photosensitive drums 20 of the processing sections 14 are successively transferred to the sheet 3. Thus, a color image is formed on the sheet 3.

When the black toner image carried on the surface of the photosensitive drum 20 of the black processing section 14K is transferred to the sheet 3, for example, the yellow toner image carried on the surface of the photosensitive drum 20 of the yellow processing section 14Y is thereafter transferred to the sheet 3 to be superposed on the black toner image. Thereafter the magenta and cyan toner images carried on the surfaces of the photosensitive drums 20 of the magenta and cyan processing sections 14M and 14C are transferred to the sheet 3 to be superposed on the black and yellow toner images. Thus, the color image is formed on the sheet 3.

In such color image formation, the color laser printer 1 having the tandem structure provided with the plurality of processing sections 14 corresponding to the respective colors can quickly form a color image by forming toner images corresponding to the respective colors at a speed generally identical to that for forming a monochromatic image. Thus, a color image can be formed while miniaturizing the color laser printer 1.

(2-4) Fixing Section

The fixing section 16 is arranged at the back of the transferring section 15 and the cyan processing section 14C and on the downstream side of the transport direction for the sheets 3. This fixing section 16 includes a heating roller 31, a pressure roller 32 and transport rollers 33.

The heating roller 31 includes a roller of a metal and a halogen lamp provided in this roller. In the heating roller 31, the halogen lamp heats the roller to a fixing temperature.

The pressure roller 32 is opposed to the heating roller 31 so as to be in pressure contact with the heating roller 31 from under the same.

The transport rollers 33 are provided at the back of the heating roller 31 and the pressure rollers 33 and on the downstream side of the transport direction for the sheets 3.

The toner images transferred to each sheet 3 in the superposed manner are heated and pressurized while the sheet 3 passes through between the heating roller 31 and the pressure roller 32, to be fixed to the sheet 3. The fixing/transport rollers 33 transport the sheet 3 having the fixed toner images to the sheet ejecting section 6.

(3) Sheet Ejecting Section

The sheet ejecting section 6 is provided at the back of the fixing section 16 and includes a sheet ejecting transport path 34 having an end arranged in the vicinity of the transport rollers 33, sheet ejecting rollers 35 provided in the vicinity of the other end of the sheet ejecting transport path 34 and a sheet ejection tray 36, as an example of face-down ejecting section serving as a recording medium ejecting section, receiving the sheet 3 ejected from the sheet ejecting rollers 35.

The sheet ejecting transport path 34 has a generally C shape opening frontward. The transport direction for the sheet 3 transported through the sheet ejecting transport path 34 is anteroposteriorly reversed in the process of transportation along the sheet ejecting transport path 34, and the face of the sheet 3 having the toner images fixed in the fixing section 16 is directed downward.

The sheet ejection tray 36 is formed by partially recessing the upper surface of the main body casing 2 downward toward the rear side from above the front side, for receiving the sheets 3 in a stackable manner. The sheets 3 transported through the sheet ejecting transport path 34 are ejected onto the sheet ejection tray 36 by the sheet ejecting rollers 35, and stacked on the sheet ejection tray 36 in a so-called face-down state in which the faces having the toner images fixed in the fixing section 16 is downwardly directed.

The sheet ejecting section 6 also includes a rear cover tray 37, as an example of face-up ejecting section serving as a recording medium ejecting section, openably/closably mounted on the rear surface (back surface) of the main body casing 2 and rear sheet ejecting rollers 38 provided on the lower end portion of the rear cover tray 37.

The rear cover tray 37 is switchable between a state tilting rearward from the main body casing 2 for partially opening the rear surface of the main body casing 2 and another state extending along the rear surface of the main body casing 2 for closing this rear surface. The inner surface of the rear cover tray 37 partially forms the sheet ejecting transport path 34, and the sheets 3 transported by the transport rollers 33 reach the sheet ejecting rollers 35 through the sheet ejecting transport path 34 while the rear cover tray 37 is closed. When the rear cover tray 37 is opened, on the other hand, the sheet ejecting transport path 34 is not formed, and the sheets 3 transported by the fixing/transport rollers 33 reach the rear sheet ejecting rollers 38 and are ejected onto the rear cover tray 37 by the rear sheet ejecting rollers 38. The sheets 3 ejected onto the rear cover tray 37 are stacked on the rear cover tray 37 in the so-called face-up state in which the faces having the toner images fixed in the fixing section 16 is upwardly directed.

2. Control System of Color Laser Printer

Figure 2:
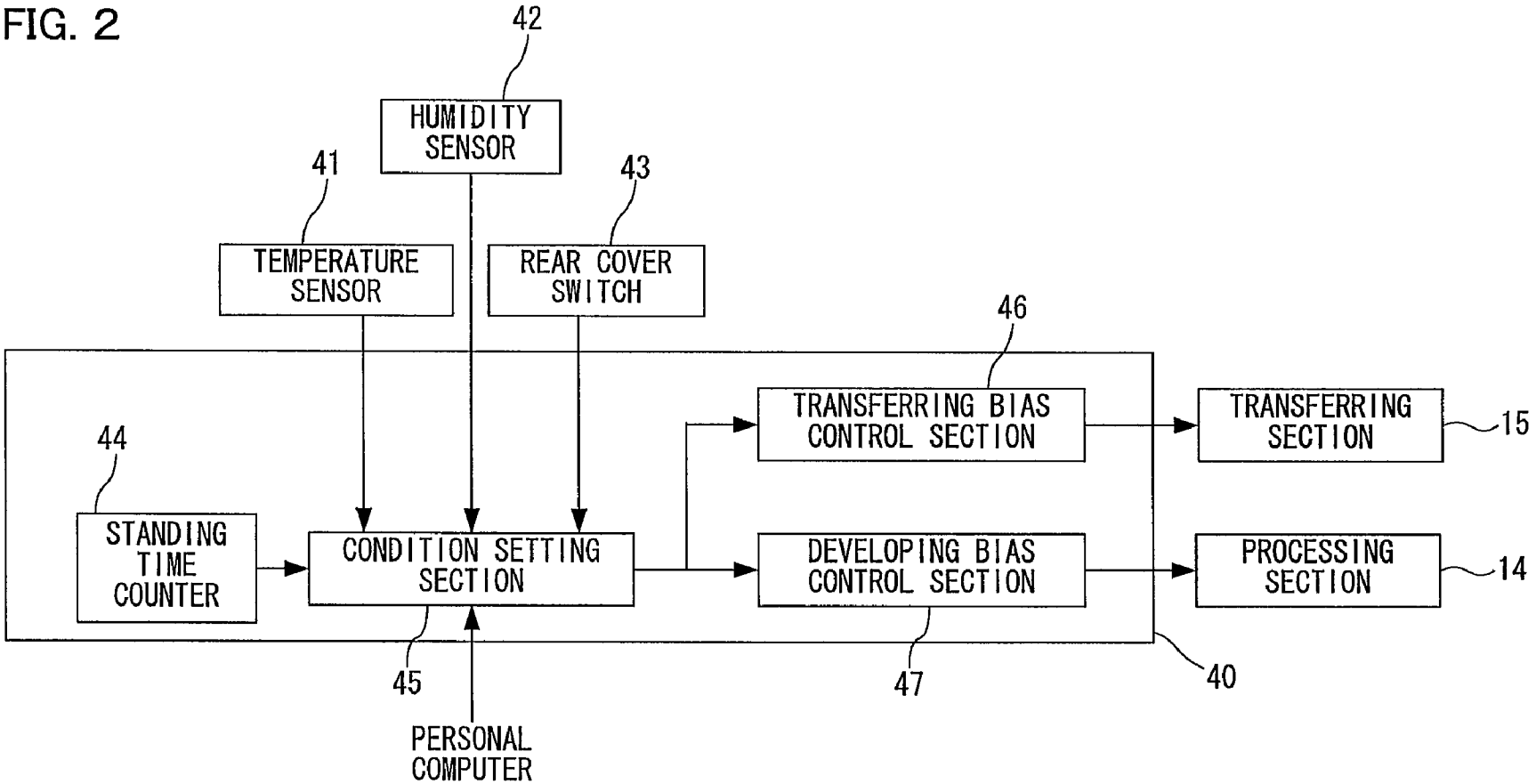
FIG. 2 is a block diagram of a control system of the color laser printer shown in FIG. 1.

FIG. 2 is a block diagram showing the control system of the color laser printer 1.

This color laser printer 1 includes a microcomputer 40 serving as a first storage section and a second storage section including a CPU, a RAM, a ROM and the like, a temperature sensor 41 for detecting the temperature of the working environment of the color laser printer 1, a humidity sensor 41 serving as a humidity detecting unit for detecting the humidity (relative humidity) of the working environment of the color laser printer 1, and a rear cover switch 43 turned on when the rear cover tray 37 is opened and turned off when the rear cover tray 37 is closed. Detection signals from the temperature sensor 41, the humidity sensor 42 and the rear cover switch 43 are input in the microcomputer 40.

The microcomputer 40 includes a standing time counter 44, as an example of elapsed time counting section, constituted of a RAM counter, for example. The microcomputer 40 also substantially includes: a condition setting section 45 setting various operating conditions of the image forming section 5 on the basis of the detection signals received from the temperature sensor 41, the humidity sensor 42 and the rear cover switch 43, the count of the standing time counter 44 and information received from a personal computer (not shown; hereinafter referred to as "PC"); a transferring bias control section 46 as an example of control section controlling the transferring section 15 (more specifically, a power source generating a transferring bias to be supplied to each transfer roller 30) on the basis of the transferring bias set by the condition setting section 45; and a developing bias control section 47 as an example of control section controlling the processing section 14 (more specifically, a power source generating a developing bias to be supplied to the developing rollers 24) on the basis of a developing bias set by the condition setting section 45. All of the condition setting section 45, the transferring bias control section 46 and the developing bias control section 47 are functional processing sections implemented by programming through the CPU in a software manner.

3. Image Formation Control

Figure 3:
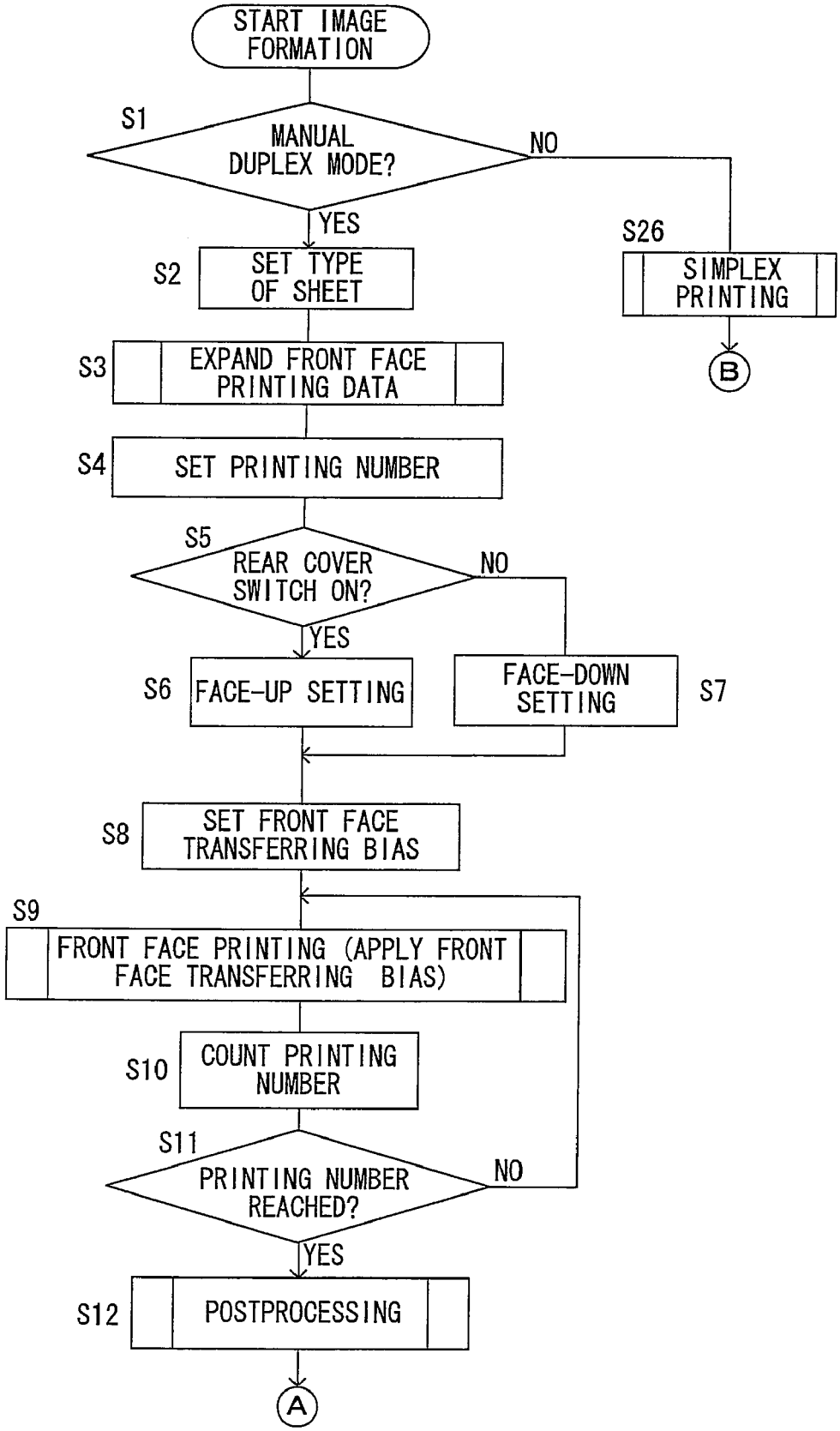
FIG. 3 is a flow chart for illustrating image formation control run by a microcomputer shown in FIG. 2.
Figure 4:
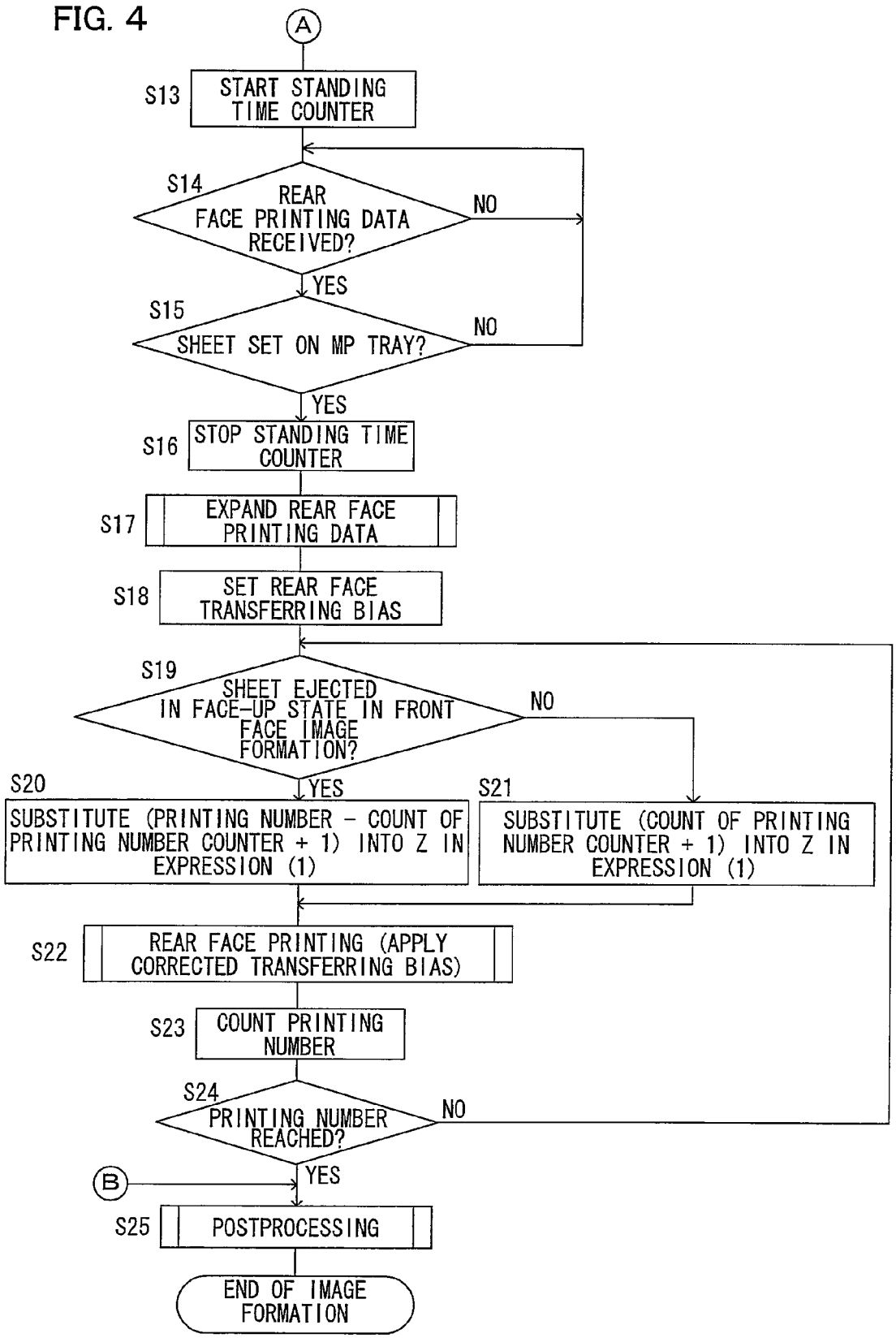
FIG. 4 is another flow chart for illustrating the image formation control run by the microcomputer shown in FIG. 2.

FIGS. 3 and 4 are flow charts for illustrating image formation control (processing performed by the condition setting section 45 and the transferring bias control section 46, in particular) run by the microcomputer 40.

The color laser printer 1 has two operation modes. The first one is a simplex mode for forming an image only on the front face of each sheet 3 and terminating image formation by ejecting the sheet 3 onto the sheet ejection tray 36 or the rear cover tray 37. The second one is a manual duplex mode for forming an image on the front face, serving as a first image forming face, of each sheet 3, ejecting the sheet 3 onto the sheet ejection tray 36 or the rear cover tray 37, thereafter forming another image on the rear face (opposite to the front face), serving as a second image forming face, of the sheet 3 when the user sets the ejected sheet 3 on the multipurpose tray 11 and the PC instructs initiation of image formation, and terminating the image formation by ejecting the sheet 3 onto the sheet ejection tray 36 or the rear cover tray 37. The user can selectively set either operation mode on the PC connected to the color laser printer 1, for example.

In initiation of image formation, the user sets the type (thin paper, plain paper or cardboard) and the width (along the direction perpendicular to the sheet transport direction) of the used sheets 3, the number of the sheets 3 (printing number) to be formed with images and the like on the PC. The PC transmits the information related to this setting to the microcomputer 40 of the color laser printer 1, along with a command instructing initiation of the image formation, data (front face printing data) of the image to be formed on the front faces of the sheets 3 and the like.

Referring to FIG. 3, the microcomputer 40 first determines whether or not the operation mode set by the user is the manual duplex mode (S1) when receiving the command instructing initiation of the image formation from the PC.

If the operation mode is the manual duplex mode (YES at S1), the microcomputer 40 sets the information on the type of the sheets 3 received from the PC in the RAM (S2). The microcomputer 40 also sets the information on the printing number received from the PC in the RAM (S4). The microcomputer 40 further expands the front face printing data received from the PC on a bitmap memory (not shown) provided therein (S3).

Then, the microcomputer 40 checks whether or not the detection signal received from the rear cover switch 43 is in an ON-state (S5). In other words, the microcomputer 40 determines whether or not the rear cover tray 37 is open on the basis of the detection signal received from the rear cover switch 43. If the rear cover tray 37 is open (YES at S5), the RAM is so set as to eject the sheets 3 onto the rear cover tray 37 (face-up setting at S6). If the rear cover tray 37 is closed (NO at S5), on the other hand, the RAM is so set as to eject the sheets 3 onto the sheet ejection tray 36 (face-down setting at S7).

Then, a front face transferring bias (transfer current) is set through transferring bias setting described later (S8).

Thereafter processing (front face printing) for forming the image on the front face of each sheet 3 is performed (S9).

More specifically, the sheet 3 is fed from the sheet feeding cassette 7 or the multipurpose tray 11, and transported at a speed (generally half speed of that for thin paper or plain paper when the sheet 3 is formed by cardboard) corresponding to the type of the sheet 3. The image forming section 5 forms the image on the front face of the sheet 3 on the basis of the front face printing data expanded on the bitmap memory. At this time, each transfer roller 30 is supplied with the front face transferring bias set in the transferring bias setting. The sheet 3 formed with the image on the front face thereof is ejected onto the sheet ejection tray 36 or the rear cover tray 37 on the basis of the setting on the RAM.

When the image is formed on a single sheet 3, the count of a printing number counter (not shown) set in the RAM is incremented (+1) (S10). Then, the microcomputer 40 checks whether or not the incremented count of the printing number counter has reached the printing number set in the RAM (S11). If the count has not yet reached the printing number (NO at S11), front face printing is performed again for forming the image on the front face of the subsequent sheet 3 (S9). When this front face printing is terminated, the count of the printing number counter is incremented (S10). When the front face printing is repeatedly performed by the printing number set in the RAM, postprocessing is performed such as resetting the count of the printing number counter to zero (S12), thereby terminating the operation (front face image formation) for forming the image on the front faces of the sheets 3.

Referring to FIG. 4, the standing time counter 44 is started (S13) upon termination of the front face image formation, for starting counting the elapsed time (minutes) from the termination of the front face image formation. Thereafter the microcomputer 40 repetitively determines whether or not data (rear face printing data) of another image to be formed on the rear face of each sheet 3 has been received from the PC along with a command instructing initiation of an operation for forming the image on the rear face of each sheet 3 (S14). The microcomputer 40 further repetitively checks whether or not the sheets 3 having the images formed on the front faces thereof have been set on the multipurpose tray 11 (S15). The microcomputer 40 can determine whether or not the sheets 3 have been set on the multipurpose tray 11 on the basis of a detection signal received from a sheet detection switch (not shown) provided in relation to the multipurpose tray 11, for example.

When the microcomputer 40 determines that the rear face printing data has been received and the sheets 3 have been set on the multipurpose tray 11 (YES at S14 and S15), the standing time counter 44 is stopped (S16), thereby retaining the current count of the standing time counter 44.

Thereafter the rear face printing data received from the PC is expanded on the bitmap memory (not shown) provided in the microcomputer 40 (S17). Further, a rear face transferring bias (transfer current) is set by transferring bias setting described later (S18).

Then, the microcomputer 40 determines whether the sheets 3 have been ejected onto the sheet ejection tray 36 or the rear cover tray 37 in the front face image formation. In other words, the microcomputer 40 determines whether or not the sheets 3 have been ejected onto the rear cover tray 37 in the face-up state in the front face image formation (S19).

If the sheets 3 have been ejected onto the rear cover tray 37 in the front face image formation (YES at S19), a corrected rear face transferring bias corresponding to the ejection destination of the sheets 3 in the front face image formation is obtained through substituting a value obtained by subtracting the count (zero at this point of time when no image has yet been formed on the rear faces of the sheets 3) of the printing number counter from the printing number set in the RAM and through adding 1 to the result into "Z" in the following expression (1). If the sheets 3 have been ejected onto the sheet ejection tray 36 in the front face image formation (NO at S19), another corrected rear face transferring bias corresponding to the ejection destination of the sheets 3 in the front face image formation is obtained by substituting a value obtained by adding 1 to the count (zero at this point of time when no image has yet been formed on the rear faces of the sheets 3) of the printing number counter into "Z" in the following expression (1):

$$\text{Corrected rear face transferring bias} = \text{rear face transferring bias} \times \exp[-B \times (C \times D)/(Z \times F)] + \text{front face transferring bias} \times [1 - \exp\{-B \times (C \times D)/(Z \times F)\}] \quad (1)$$

B: constant

C: elapsed time counted by standing time counter 44

D: humidity detected by humidity sensor 42

E: count of printing number counter

F: constant (0.8 for thin paper, 1 for plain paper or 1.5 for cardboard) corresponding to the type of sheet 3

Thus, if the sheets 3 have been ejected onto the rear cover tray 37 in the front face image formation, the corrected rear face transferring bias is set lower as the execution frequency (count of the printing number counter) of rear face printing described later is increased. If the sheets 3 have been ejected onto the sheet ejection tray 36 in the front face image formation, on the other hand, the corrected rear face transferring bias is set higher as the count of the printing number counter is increased.

The sheets 3 ejected onto the sheet ejection tray 36 or the rear cover tray 37 absorb the ambient humidity successively from the uppermost one. Thus, it is conceivable that the sheets 3 located on higher positions are more humid and exhibit smaller electric resistances as compared with those located on lower positions.

The sheets 3 are ejected onto the rear cover tray 37 in the face-up state, and therefore, are so set on the multipurpose tray 11 that the uppermost sheet 3 on the rear cover tray 37 is located on the lowermost position in the multipurpose tray 11. Thus, it is conceivable that the sheets 3 located on lower positions in the multipurpose tray 11 are more humid and exhibit smaller electric resistances as compared with those located on higher positions. Therefore, the corrected rear face transferring bias is set lower as the count of the printing number counter is increased, so that the toner images of the respective colors can be excellently transferred to the front or rear faces of the sheets 3 in the rear face transfer processing described later.

On the other hand, the sheets 3 are ejected onto the sheet ejection tray 36 in the face-down state, and therefore, are so set on the multipurpose tray 11 that the uppermost sheet 3 on the sheet ejection tray 36 is located on the uppermost position in the multipurpose tray 11. Thus, it is conceivable that the sheets 3 located on lower positions in the multipurpose tray 11 are drier and exhibit larger electric resistances as compared with those located on higher positions. Therefore, the corrected rear face transferring bias is set higher as the count of the printing number counter is increased, so that the toner images of the respective colors can be excellently transferred to the front or rear faces of the sheets 3 in the rear face transfer processing described later.

When the corrected rear face transferring bias is set in the aforementioned manner, the processing (rear face printing) for forming the other image on the rear faces of the sheets 3 is performed (S22). More specifically, each sheet 3 is fed from the multipurpose tray 11 and transported at the speed (generally half speed of that for thin paper or plain paper when the sheet 3 is formed by cardboard) corresponding to the type of the sheet 3, so that the image forming section 5 forms the image on the rear face of the sheet 3 on the basis of the rear face printing data expanded on the bitmap memory. At this time, each transfer roller 30 is supplied with the corrected rear face transferring bias. The sheet 3 formed with the image on the rear face is ejected onto the sheet ejection tray 36 or the rear cover tray 37 on the basis of the setting on the RAM.

When the image is formed on a single sheet 3, the count of the printing number counter (not shown) set in the RAM is incremented (+1) (S23). Then, the microcomputer 40 checks whether or not the incremented count of the printing number counter has reached the printing number set in the RAM (S24). If the count has not yet reached the printing number (NO at S24), the aforementioned processing through S19 to S23 is performed again. When the rear face printing is repeatedly performed by the printing number set in the RAM, postprocessing is performed such as resetting the count of the printing number counter to zero (S25), thereby terminating the serial image formation control for forming the images on the front and rear faces of the sheets 3.

Referring again to FIG. 3, predetermined simplex printing is performed if the operation mode set by the user is not the manual duplex mode (NO at S1), i.e. if the operation mode is the simplex mode. Then, the postprocessing at S25 shown in FIG. 4 is performed, thereby terminating the serial image formation control for forming the images on the front faces of the sheets 3. Since the simplex printing is similar to the aforementioned front face printing, detailed description thereof is omitted.

4. Condition Setting (Transferring Bias Setting)

Figure 5:
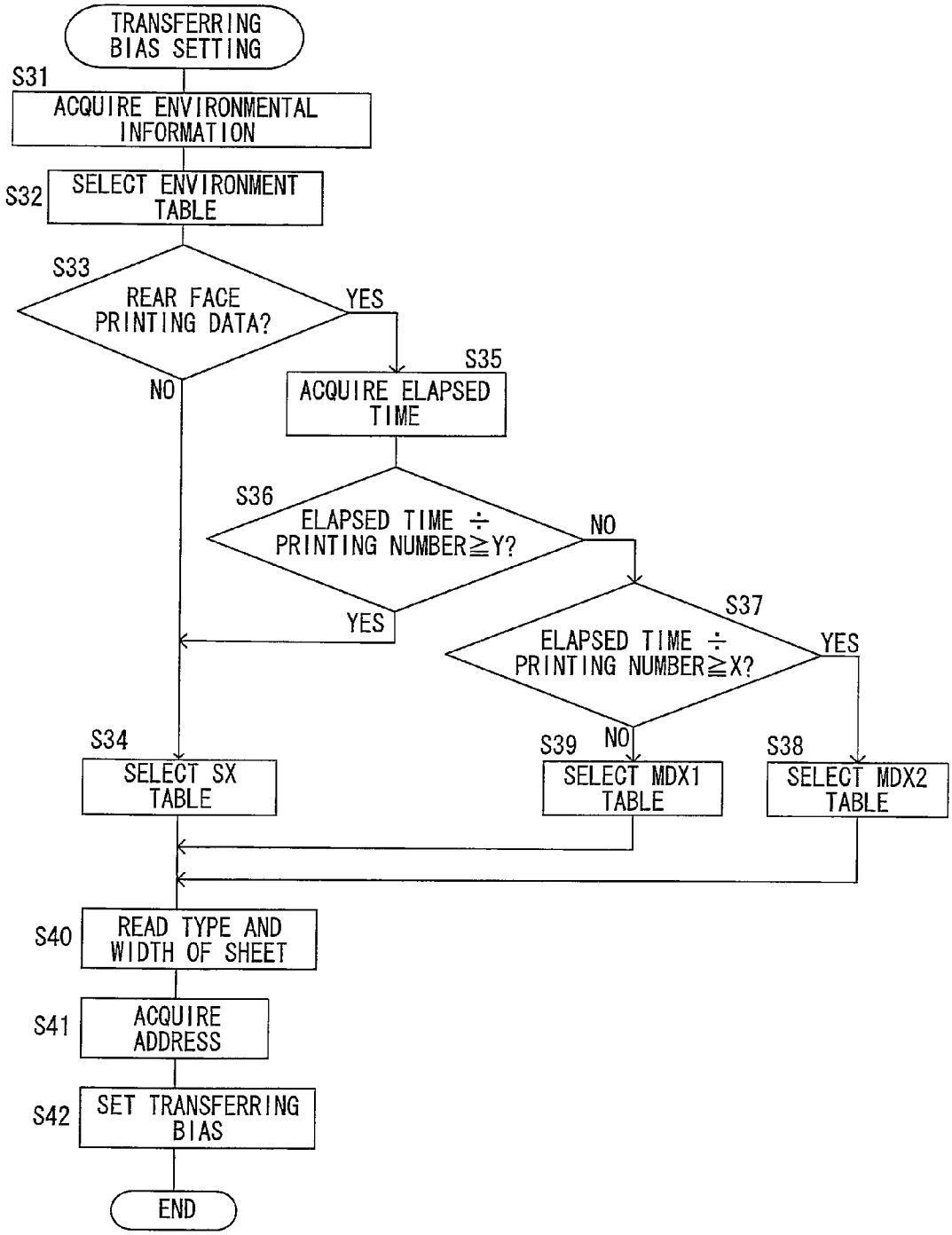
FIG. 5 is a flow chart for illustrating transferring bias setting performed by a condition setting section shown in FIG. 2.
Figure 6:
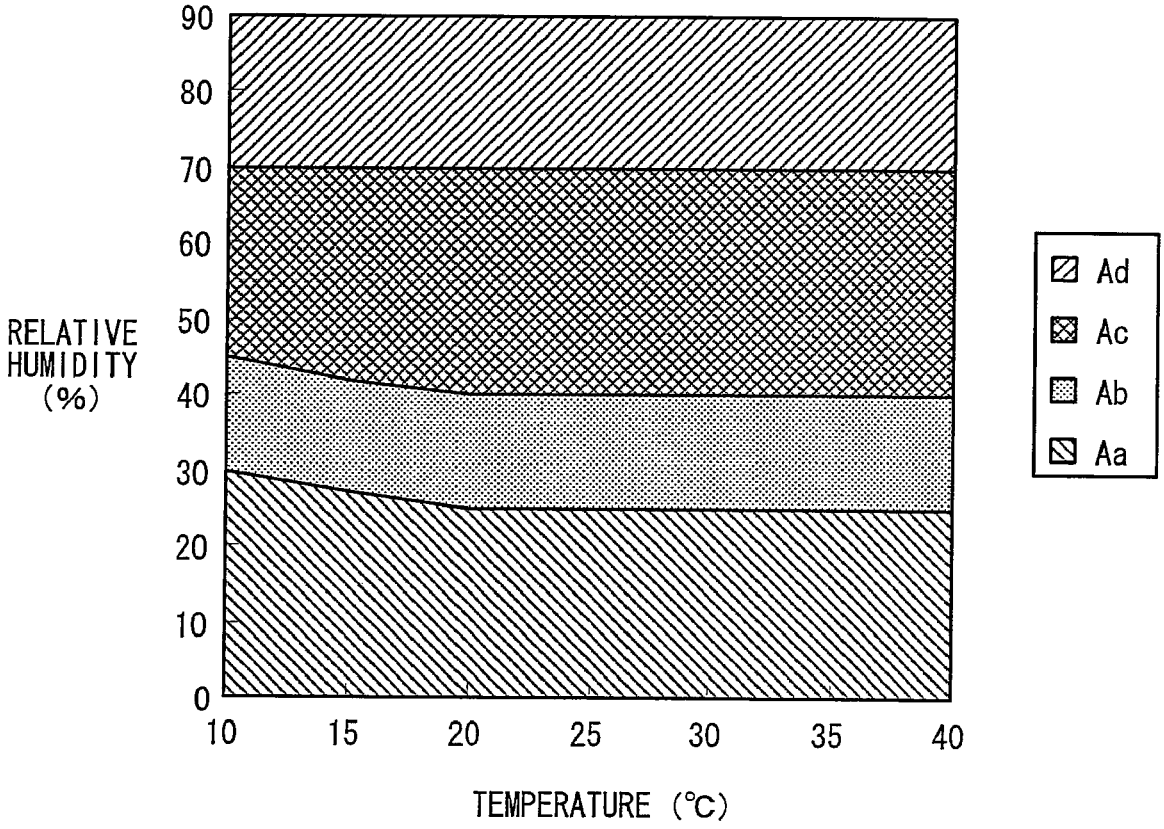
FIG. 6 illustrates example of contents of a selection table referred to in the transferring bias setting shown in FIG. 5.

FIG. 5 is a flow chart for illustrating the transferring bias setting. FIG. 6 illustrates an example of contents of a selection table referred to in the transferring bias setting. FIGS. 7A, 8A, 9A and 10A each illustrate an example of environment table used in the transferring bias setting, and FIGS. 7B, 8B, 9B and 10B each illustrate of an example of transferring bias table used in the transferring bias setting.

The condition setting section 45 of the microcomputer 40 performs the transferring bias setting.

Referring to FIG. 5, the condition setting section 45 first refers to the detection signals received from the temperature sensor 41 and the humidity sensor 42, for acquiring environmental information including the temperature and the humidity of the working environment of the color laser printer 1 (S31). Then, the condition setting section 45 refers to the selection tables stored in the ROM of the microcomputer 40 and selects one of the environmental tables shown in FIGS. 7A, 8A, 9A and 10A corresponding to the temperature and the humidity of the working environment (S32).

The selection table is prepared by tabulating a graph shown in FIG. 6. The graph of FIG. 6 shows the relative humidity and the temperature on the axis of ordinate and the axis of abscissa, respectively, and the rectangular region defined by the axes of ordinate and abscissa is divided into four areas Aa, Ab, Ac and Ad. The boundary between the areas Aa and Ab generally linearly inclines from the point of 10° C. in temperature and 30% in relative humidity to the point of 20° C. in temperature and 27% in relative humidity, and generally linearly extends from the point of 20° C. in temperature and 27% in relative humidity to the point of 40° C. in temperature and 27% in relative humidity. The boundary between the areas Ab and Ac generally inclines from the point of 10° C. in temperature and 45% in relative humidity to the point of 20° C. in temperature and 40% in relative humidity, and generally linearly extends from the point of 20° C. in temperature and 40% in relative humidity to the point of 40° C. in temperature and 40% in relative humidity. The boundary between the areas Ac and Ad generally linearly extends from the point of 10° C. in temperature and 70% in relative humidity to the point of 40° C. in temperature and 70% in relative humidity.

The condition setting section 45 checks which one of the areas Aa, Ab, Ac and Ad shown in FIG. 6 includes the temperature and the humidity of the working environment acquired from the detection signals received from the temperature sensor 41 and the humidity sensor 42 respectively. If the area Aa includes the humidity of the working environment, the environment table shown in FIG. 7A is selected. If the area Ab includes the humidity of the working environment, the environment table shown in FIG. 8A is selected. If the area Ac includes the humidity of the working environment, the environment table shown in FIG. 9A is selected. If the area Ad includes the humidity of the working environment, the environment table shown in FIG. 10A is selected.

Each environment table includes three tables, i.e., SX, MDX1 and MDX2 tables, as shown in each of FIGS. 7A, 8A, 9A and 10A. The SX, MDX1 and MDX2 tables are created by storing addresses of the transferring bias tables shown in FIGS. 7B, 8B, 9B and 10B respectively in the ROM in association with combinations of the types (thicknesses) and the widths of the sheets 3.

The SX table shown in FIG. 7A stores addresses "2", "2" and "1" in association with combinations of thin paper (thin) and a width of not more than 120 mm, thin paper (thin) and a width of 120 to 170 mm and thin paper (thin) and a width of not less than 170 mm respectively. This SX table also stores addresses "2", "1" and "1" in association with combinations of plain paper (ordinary) and a width of not more than 120 mm, plain paper (ordinary) and a width of 120 to 170 mm and plain paper (ordinary) and a width of not less than 170 mm respectively. The SX table further stores addresses "11", "11" and "11" in association with combinations of cardboard (thick) and a width of not more than 120 mm, cardboard (thick) and a width of 120 to 170 mm and cardboard (thick) and a width of not less than 170 mm respectively.

The MXD1 table shown in FIG. 7A stores addresses "4", "3" and "2" in association with combinations of thin paper (thin) and a width of not more than 120 mm, thin paper (thin) and a width of 120 to 170 mm and thin paper (thin) and a width of not less than 170 mm respectively. This MXD1 table also stores addresses "4", "3" and "2" in association with combinations of plain paper (ordinary) and a width of not more than 120 mm, plain paper (ordinary) and a width of 120 to 170 mm and plain paper (ordinary) and a width of not less than 170 mm respectively. The MXD1 table further stores addresses "13", "12" and "11" in association with combinations of cardboard (thick) and a width of not more than 120 mm, cardboard (thick) and a width of 120 to 170 mm and cardboard (thick) and a width of not less than 170 mm respectively.

The MXD2 table shown in FIG. 7A stores addresses "3", "2" and "1" in association with combinations of thin paper (thin) and a width of not more than 120 mm, thin paper (thin) and a width of 120 to 170 mm and thin paper (thin) and a width of not less than 170 mm respectively. This MXD2 table also stores addresses "3", "2" and "1" in association with combinations of plain paper (ordinary) and a width of not more than 120 mm, plain paper (ordinary) and a width of 120 to 170 mm and plain paper (ordinary) and a width of not less than 170 mm respectively. The MXD2 table further stores addresses "12", "11" and "11" in association with combinations of cardboard (thick) and a width of not more than 120 mm, cardboard (thick) and a width of 120 to 170 mm and cardboard (thick) and a width of not less than 170 mm respectively.

The SX table shown in FIG. 8A stores addresses "2", "1" and "1" in association with combinations of thin paper (thin) and a width of not more than 120 mm, thin paper (thin) and a width of 120 to 170 mm and thin paper (thin) and a width of not less than 170 mm respectively. This SX table also stores addresses "1", "1" and "1" in association with combinations of plain paper (ordinary) and a width of not more than 120 mm, plain paper (ordinary) and a width of 120 to 170 mm and plain paper (ordinary) and a width of not less than 170 mm respectively. The SX table further stores addresses "11", "11" and "11" in association with combinations of cardboard (thick) and a width of not more than 120 mm, cardboard (thick) and a width of 120 to 170 mm and cardboard (thick) and a width of not less than 170 mm respectively.

The MDX1 table shown in FIG. 8A stores addresses "2", "2" and "1" in association with combinations of thin paper (thin) and a width of not more than 120 mm, thin paper (thin) and a width of 120 to 170 mm and thin paper (thin) and a width of not less than 170 mm respectively. This MDX1 table also stores addresses "2", "2" and "1" in association with combinations of plain paper (ordinary) and a width of not more than 120 mm, plain paper (ordinary) and a width of 120 to 170 mm and plain paper (ordinary) and a width of not less than 170 mm respectively. The MDX1 table further stores addresses "12", "12" and "11" in association with combinations of cardboard (thick) and a width of not more than 120 mm, cardboard (thick) and a width of 120 to 170 mm and cardboard (thick) and a width of not less than 170 mm respectively.

The MDX2 table shown in FIG. 8A stores addresses "2", "2" and "1" in association with combinations of thin paper (thin) and a width of not more than 120 mm, thin paper (thin) and a width of 120 to 170 mm and thin paper (thin) and a width of not less than 170 mm respectively. This MDX2 table also stores addresses "2", "1" and "1" in association with combinations of plain paper (ordinary) and a width of not more than 120 mm, plain paper (ordinary) and a width of 120 to 170 mm and plain paper (ordinary) and a width of not less than 170 mm respectively. The MDX2 table further stores addresses "12", "11" and "11" in association with combinations of cardboard (thick) and a width of not more than 120 mm, cardboard (thick) and a width of 120 to 170 mm and cardboard (thick) and a width of not less than 170 mm respectively.

The SX table shown in FIG. 9A stores addresses "3", "3" and "3" in association with combinations of thin paper (thin) and a width of not more than 120 mm, thin paper (thin) and a width of 120 to 170 mm and thin paper (thin) and a width of not less than 170 mm respectively. This SX table also stores addresses "2", "3" and "3" in association with combinations of plain paper (ordinary) and a width of not more than 120 mm, plain paper (ordinary) and a width of 120 to 170 mm and plain paper (ordinary) and a width of not less than 170 mm respectively. The SX table further stores addresses "11", "12" and "13" in association with combinations of cardboard (thick) and a width of not more than 120 mm, cardboard (thick) and a width of 120 to 170 mm and cardboard (thick) and a width of not less than 170 mm respectively.

The MDX1 table shown in FIG. 9A stores addresses "4", "3" and "3" in association with combinations of thin paper (thin) and a width of not more than 120 mm, thin paper (thin) and a width of 120 to 170 mm and thin paper (thin) and a width of not less than 170 mm respectively. This MDX1 table also stores "3", "3" and "3" in association with combinations of plain paper (ordinary) and a width of not more than 120 mm, plain paper (ordinary) and a width of 120 to 170 mm and plain paper (ordinary) and a width of not less than 170 mm respectively. The MDX1 table further stores addresses "13", "13" and "13" in association with combinations of cardboard (thick) and a width of not more than 120 mm, cardboard (thick) and a width of 120 to 170 mm and cardboard (thick) and a width of not less than 170 mm respectively.

The MDX2 table shown in FIG. 9A stores addresses "3", "3" and "3" in association with combinations of thin paper (thin) and a width of not more than 120 mm, thin paper (thin) and a width of 120 to 170 mm and thin paper (thin) and a width of not less than 170 mm respectively. This MDX2 table also stores addresses "3", "3" and "3" in association with combinations of plain paper (ordinary) and a width of not more than 120 mm, plain paper (ordinary) and a width of 120 to 170 mm and plain paper (ordinary) and a width of not less than 170 mm respectively. The MDX2 table further stores addresses "12", "13" and "13" in association with combinations of cardboard (thick) and a width of not more than 120 mm, cardboard (thick) and a width of 120 to 170 mm and cardboard (thick) and a width of not less than 170 mm respectively.

The SX table shown in FIG. 10A stores addresses "1", "2" and "3" in association with combinations of thin paper (thin) and a width of not more than 120 mm, thin paper (thin) and a width of 120 to 170 mm and thin paper (thin) and a width of not less than 170 mm respectively. This SX table also stores addresses "1", "2" and "3" in association with combinations of plain paper (ordinary) and a width of not more than 120 mm, plain paper (ordinary) and a width of 120 to 170 mm and plain paper (ordinary) and a width of not less than 170 mm respectively. The SX table further stores addresses "11", "12" and "13" in association with combinations of cardboard (thick) and a width of not more than 120 mm, cardboard (thick) and a width of 120 to 170 mm and cardboard (thick) and a width of not less than 170 mm respectively.

The MDX1 table shown in FIG. 10A stores addresses "7", "7" and "7" in association with combinations of thin paper (thin) and a width of not more than 120 mm, thin paper (thin) and a width of 120 to 170 mm and thin paper (thin) and a width of not less than 170 mm respectively. This MDX1 table also stores addresses "7", "7" and "7" in association with combinations of plain paper (ordinary) and a width of not more than 120 mm, plain paper (ordinary) and a width of 120 to 170 mm and plain paper (ordinary) and a width of not less than 170 mm respectively. The MDX1 table further stores addresses "16", "16" and "16" in association with combinations of cardboard (thick) and a width of not more than 120 mm, cardboard (thick) and a width of 120 to 170 mm and cardboard (thick) and a width of not less than 170 mm respectively.

The MDX2 table shown in FIG. 10A stores addresses "5", "6" and "6" in association with combinations of thin paper (thin) and a width of not more than 120 mm, thin paper (thin) and a width of 120 to 170 mm and thin paper (thin) and a width of not less than 170 mm, respectively. This MDX2 table also stores addresses "5", "5" and "6" in association with combinations of plain paper (ordinary) and a width of not more than 120 mm, plain paper (ordinary) and a width of 120 to 170 mm and plain paper (ordinary) and a width of not less than 170 mm respectively. The MDX2 table further stores addresses "14", "14" and "15" in association with combinations of cardboard (thick) and a width of not more than 120 mm, cardboard (thick) and a width of 120 to 170 mm and cardboard (thick) and a width of not less than 170 mm respectively.

Referring again to FIG. 5, the condition setting section 45 determines upon selection of the environment table whether or not the printing data currently expanded on the bitmap memory of the microcomputer 40 is the rear face printing data (S33). If the printing data is not the rear face printing data (NO at S33), i.e., if the printing data is the front face printing data for front face image formation, the SX table included in the environment table selected at S32 is selected as the table to be referred to for setting the front face transferring bias (S34).

If the printing data currently expanded on the bitmap memory is the rear face printing data for rear face image formation (YES at S33), on the other hand, the elapsed time (from termination of the front face image formation) counted by the standing time counter 44 through S13 to S16 shown in FIG. 4 is acquired (S35). Then, the condition setting section 45 determines whether or not a quotient obtained by dividing the acquired elapsed time with the printing number set in the RAM is at least a predetermined value Y (S36).

If the quotient is not less than Y (YES at S36), the SX table included in the environment table selected at S32 is selected as the table to be referred to for setting the rear face transferring bias (S34). In other words, a long time has passed after termination of the front face image formation if the quotient is not less than Y, and the sheets 3 formed with the images on the front faces thereof have conceivably been left on the sheet ejection tray 36 or the rear cover tray 37 to absorb the ambient humidity, thereby returning to the state before the image formation. If the quotient is not less than Y, therefore, the SX table included in the environment table selected at S32 is selected similarly to the case where the printing data currently expanded on the bitmap memory is the front face printing data.

If the quotient is less than Y (NO at S36), on the other hand, the condition setting section 45 further determines whether or not the quotient is not less than X (X=1, for example) (S37). If the quotient is not less than X and less than Y (Y=3, for example) (YES at S37), the MDX2 table included in the environment table selected at S32 is selected as the table to be referred to for setting the rear face transferring bias (S38). If the quotient is less than X (NO at S37), on the other hand, the MDX1 table included in the environment table selected at S32 is selected as the table to be referred to for setting the rear face transferring bias (S39).

When the table (reference table) to be referred to is selected in the aforementioned manner, the condition setting section 45 reads the information on the type and the width of the sheets 3 stored in the RAM (S40). Then, the condition setting section 45 refers to the reference table and acquires the address corresponding to the type (thickness) and the width of the sheets 3 (S41).

The ROM of the microcomputer 40 stores the transferring bias tables shown in FIGS. 7B, 8B, 9B and 10B in association with the environment tables shown in FIGS. 7A, 8A, 9A and 10A respectively. Each transferring bias table stores transferring biases to be supplied to the transfer rollers 30 of the black, yellow, magenta and cyan processing sections 14K, 14Y, 14M and 14C respectively per address.

The transferring bias table shown in FIG. 7B is stored in the ROM in association with the environment table shown in FIG. 7A. This transferring bias table shown in FIG. 7B stores 9 μA, 10 μA, 11 μA and 12 μA as transferring biases (hereinafter referred to as black, yellow, magenta and cyan transferring biases respectively) for the transfer rollers 30 of the black, yellow, magenta and cyan processing sections 14K, 14Y, 14M and 14C respectively in association with the address "1". The transferring bias table also stores 10 μA, 11 μA, 12 μA and 13 μA as black, yellow, magenta and cyan transferring biases respectively in association with the address "2". Thus, the transferring bias table shown in FIG. 7B stores black, yellow, magenta and cyan transferring biases in association with the addresses "1", "2", "3", "4", "11", "12" and "13" respectively.

The transferring bias table shown in FIG. 8B is stored in the ROM in association with the environment table shown in FIG. 8A. This transferring bias table shown in FIG. 8B stores 9 μA, 10 μA, 11 μA and 12 μA as black, yellow, magenta and cyan transferring biases respectively in association with the address "1". The transferring bias table also stores 10 μA, 11 μA, 12 μA and 13 μA as black, yellow, magenta and cyan transferring biases respectively in association with the address "2". Thus, the transferring bias table shown in FIG. 8B stores black, yellow, magenta and cyan transferring biases in association with the addresses "1", "2", "3", "4", "11", "12" and "13" respectively.

The transferring bias table shown in FIG. 9B is stored in the ROM in association with the environment table shown in FIG. 9A. This transferring bias table shown in FIG. 9B stores 7 μA, 8 μA, 9 μA and 10 μA as black, yellow, magenta and cyan transferring biases respectively in association with the address "1". The transferring bias table also stores 8 μA, 9 μA, 10 μA and 11 μA as black, yellow, magenta and cyan transferring biases respectively in association with the address "2". Thus, the transferring bias table shown in FIG. 9B stores black, yellow, magenta and cyan transferring biases in association with the addresses "1", "2", "3", "4", "11", "12" and "13" respectively.

The transferring bias table shown in FIG. 10B is stored in the ROM in association with the environment table shown in FIG. 10A. This transferring bias table shown in FIG. 10B stores 9 μA, 8 μA, 9 μA and 12 μA as black, yellow, magenta and cyan transferring biases respectively in association with the address "1". The transferring bias table also stores 10 μA, 9 μA, 10 μA and 13 μA as black, yellow, magenta and cyan transferring biases respectively in association with the address "2". Thus, the transferring bias table shown in FIG. 10B stores black, yellow, magenta and cyan transferring biases in association with the addresses "1", "2", "3", "4", "5", "6", "7", "11", "12", "13", "14", "15" and "16" respectively.

Referring again to FIG. 5, the condition setting section 45 supplies the address acquired from the reference table to the transferring bias table associated with the reference table, thereby reading the black, yellow, magenta and cyan transferring biases from this transferring bias table. The condition setting section 45 sets the read black, yellow, magenta and cyan transferring biases as the front face transferring biases or the rear face transferring biases (S40), and terminates this transferring bias setting.

5. Exemplary Transferring Bias Setting

<Setting Example 1>

If the temperature and the humidity of the working environment are 20° C. and 20% respectively, the environment table shown in FIG. 7A is selected. If the printing data expanded on the bitmap memory of the microcomputer 40 is the front face printing data or the quotient obtained by dividing the elapsed time from termination of the front face image formation with the printing number set in the RAM is not less than Y, the SX table included in the environment table shown in FIG. 7A is selected. If the sheets 3 are thin paper having a width of not more than 120 mm, the address "2" is acquired from the SX table. This address "2" is supplied to the transferring bias table shown in FIG. 7B. Consequently, the black, yellow, magenta and cyan transferring biases are set to 10 μA, 11 μA, 12 μA and 13 μA respectively.

<Setting Example 2>

If the temperature and the humidity of the working environment are 20° C. and 20% respectively, the environment table shown in FIG. 7A is selected. If the printing data expanded on the bitmap memory of the microcomputer 40 is the front face printing data or the quotient obtained by dividing the elapsed time from termination of the front face image formation with the printing number set in the RAM is not less than Y, the SX table included in the environment table shown in FIG. 7A is selected. If the sheets 3 are thin paper having a width of not less than 170 mm, the address "1" is acquired from the SX table. This address "1" is supplied to the transferring bias table shown in FIG. 7B. Consequently, the black, yellow, magenta and cyan transferring biases are set to 9 μA, 10 μA, 11 μA and 12 μA respectively.

<Setting Example 3>

If the temperature and the humidity of the working environment are 20° C. and 20% respectively, the environment table shown in FIG. 7A is selected. If the quotient obtained by dividing the elapsed time from termination of the front face image formation with the printing number set in the RAM is less than X, the MDX1 table included in the environment table shown in FIG. 7A is selected. If the sheets 3 are thin paper having a width of not more than 120 mm, the address "4" is acquired from the MDX1 table. This address "4" is supplied to the transferring bias table shown in FIG. 7B. Consequently, the black, yellow, magenta and cyan transferring biases are set to 12 μA, 13 μA, 15 μA and 17 μA respectively.

<Setting Example 4>

If the temperature and the humidity of the working environment are 25° C. and 35% respectively, the environment table shown in FIG. 8A is selected. If the quotient obtained by dividing the elapsed time from termination of the front face image formation with the printing number set in the RAM is less than X, the MDX1 table included in the environment table shown in FIG. 8A is selected. If the sheets 3 are thin paper having a width of not more than 120 mm, the address "2" is acquired from the MDX1 table. This address "2" is supplied to the transferring bias table shown in FIG. 8B. Consequently, the black, yellow, magenta and cyan transferring biases are set to 10 μA, 11 μA, 12 μA and 13 μA respectively.

<Setting Example 5>

If the temperature and the humidity of the working environment are 25° C. and 50% respectively, the environment table shown in FIG. 9A is selected. If the printing data expanded on the bitmap memory of the microcomputer 40 is the front face printing data or the quotient obtained by dividing the elapsed time from termination of the front face image formation by the printing number set in the RAM is not less than Y, the SX table included in the environment table shown in FIG. 9A is selected. If the sheets 3 are thin paper having a width of not more than 120 mm, the address "3" is acquired from the SX table. This address "3" is supplied to the transferring bias table shown in FIG. 9B. Consequently, the black, yellow, magenta and cyan transferring biases are set to 9 μA, 10 μA, 11 μA and 12 μA respectively.

<Setting Example 6>

If the temperature and the humidity of the working environment are 25° C. and 50% respectively, the environment table shown in FIG. 9A is selected. If the printing data expanded on the bitmap memory of the microcomputer 40 is the front face printing data or the quotient obtained by dividing the elapsed time from termination of the front face image formation by the printing number set in the RAM is not less than Y, the SX table included in the environment table shown in FIG. 9A is selected. If the sheets 3 are plain paper having a width of not more than 120 mm, the address "2" is acquired from the SX table. This address "2" is supplied to the transferring bias table shown in FIG. 9B. Consequently, the black, yellow, magenta and cyan transferring biases are set to 8 μA, 9 μA, 10 μA and 11 μA respectively.

<Comparison between Setting Example 1 and Setting Example 2>

When comparing Setting Example 1 with Setting Example 2, it is understood that the black, yellow, magenta and cyan transferring biases for forming images on the front or rear faces of the sheets 3 having a relatively small width are set to values respectively exceeding those for forming images on the front or rear faces of the sheets 3 having a relatively large width if the conditions other than the width of the sheets 3 are identical in the environment having the temperature of 20° C. and the humidity of 20%.

The electric resistance of the sheets 3 having the small width remarkably influences the state of transfer of the toner images onto the sheets 3 in low current control due to the small areas occupied by the sheets 3. Therefore, when the images are formed on the sheets 3 having a relatively small width, therefore, black, yellow, magenta and cyan transferring biases higher than those for forming images on the sheets 3 having a relatively large width are supplied to the transfer rollers 30, so that the toner images of the respective colors can be excellently transferred to the front or rear faces of the sheets 3. Consequently, excellent (high-quality) images can be formed on the front or rear faces of the sheets 3 regardless of the width thereof.

<Comparison between Setting Example 1 and Setting Example 3>

When comparing Setting Example 1 with Setting Example 3, it is understood that black, yellow, magenta and cyan transferring biases for forming images on the front or rear faces of the sheets 3 after a lapse of a relatively short time are set to values respectively exceeding those for forming images on the front or rear faces of the sheets 3 after a lapse of a relatively long time if the conditions other than the elapsed time from termination of the front face image formation are identical in the working environment having the temperature of 20° C. and the humidity of 20%.

Immediately after termination of the front face image formation, the sheets 3 are dried due to the heating for fixing the toner images thereto, and exhibit a high electric resistance. If left over a long time after termination of the front face image formation, however, the sheets 3 absorb the ambient humidity to return to the state without the images formed on the faces thereof, and exhibit a low electric resistance. When the images are formed on the front or rear faces of the sheets 3 after a lapse of a relatively short time, therefore, black, yellow, magenta and cyan transferring biases higher than those for forming the images on the front or rear faces of the sheets 3 after a lapse of a relatively long time are supplied to the transfer rollers 30, so that the toner images of the respective colors can be excellently transferred to the front or rear faces of the sheets 3. Consequently, excellent (high-quality) images can be formed on the front or rear faces of the sheets 3 regardless of the elapsed time from termination of the front face image formation.

<Comparison between Setting Example 3 and Setting Example 4>

Comparing Setting Example 3 with Setting Example 4, it is understood that the black, yellow, magenta and cyan transferring biases for forming the images on the front or rear faces of the sheets 3 in the working environment of 20° C. in temperature and 20% in humidity are set to values respectively exceeding those for forming the images on the front or rear faces of the sheets 3 in the environment of 25° C. in temperature and 35% in humidity if the conditions other than the temperature and the humidity of the working environment are identical.

The sheets 3 set in the working environment of 20° C. in temperature and 20% in humidity are drier than those set in the environment of 25° C. in temperature and 35% in humidity, and exhibit a higher electric resistance. When the images are formed on the front or rear faces of the sheets 3 in the environment having a relatively low humidity, therefore, black, yellow, magenta and cyan transferring biases respectively higher than those for forming the images on the front or rear faces of the sheets 3 in the environment having relatively high humidity are supplied to the transfer rollers 30, so that the toner images of the respective colors can be excellently transferred to the front or rear faces of the sheets 3. Consequently, excellent (high-quality) images can be formed on the front or rear faces of the sheets 3 regardless of the humidity of the working environment.

<Comparison between Setting Example 5 and Setting Example 6>

When comparing Setting Example 5 with Setting Example 6, it is understood that black, yellow, magenta and cyan transferring biases for forming the images on the front or rear faces of the sheets 3 having a relatively small thickness are set to values respectively exceeding those for forming the images on the front or rear faces of the sheets 3 (plain paper) having an ordinary thickness if the conditions other than the thickness of the sheets 3 are identical in the environment of 25° C. in temperature and 50% in humidity.

The sheets 3 having a small thickness generally exhibit a higher electric resistance than the sheets 3 having a large thickness. When the images are formed on the sheets 3 having a relatively small thickness, therefore, black, yellow, magenta and cyan transferring biases respectively higher than those for forming the images on the sheets 3 having a relatively large thickness are supplied to the transfer rollers 30, so that the toner images of the respective colors can be excellently transferred to the front or rear faces of the sheets 3. Consequently, excellent (high-quality) images can be formed on the front or rear faces of the sheets 3 regardless of the width thereof.

As hereinabove described, the front and rear face transferring biases for forming the images on the front and rear faces of the sheets 3 respectively are individually set in the manual duplex mode. Therefore, the transferring biases can be optimally set in formation of the images on the front faces of the sheets 3 and in formation of the images on the rear faces of the sheets 3 respectively, so that the image forming section 5 can operate with optimum transferring biases respectively. Consequently, excellent images can be formed on both faces of the sheets 3 in the manual duplex mode.

6. Other Condition Setting

Figure 11:
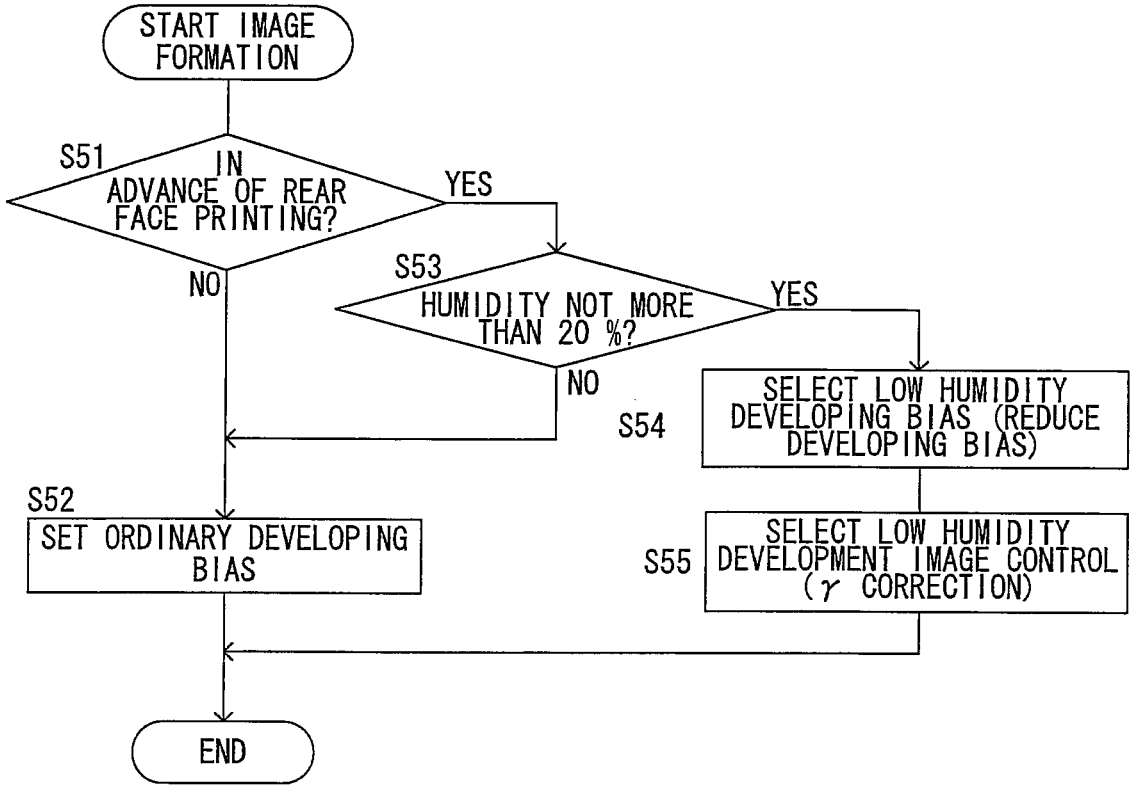
FIG. 11 is a flow chart for illustrating other condition settings (processing for setting a developing bias) performed by the condition setting section shown in FIG. 2.

FIG. 11 is a flow chart for illustrating other condition setting performed by the condition setting section 45.

This processing is for setting the developing bias for forming the images on the front and rear faces of the sheets 3, and is performed in advance of the front face printing (S9 in FIG. 3) for forming the images on the front faces of the sheets 3 and the rear face printing (S22 in FIG. 4) for forming the images on the rear faces of the sheets 3.

First, the microcomputer 40 determines whether or not the process is in advance of the rear face printing (S51).

If the process is not in advance of the rear face printing (NO at S51), i.e., in advance of the front face printing, the microcomputer 40 sets the developing bias to a predetermined ordinary developing bias (S52), and terminates this condition setting.

If the process is in advance of the rear face printing (YES at S51), on the other hand, the microcomputer 40 checks whether the humidity of the working environment acquired from the detection signal received from the humidity sensor 42 is not more than 20% (S53). If the humidity of the working environment is higher than 20%, the microcomputer 40 sets the developing bias to the predetermined ordinary developing bias (S52), and terminates this condition setting.

If the temperature of the working environment is not more than 20%, on the other hand, the microcomputer 40 sets the developing bias to a low humidity developing bias lower than the ordinary developing bias (S53). Further, the microcomputer 40 sets low humidity development image control (γ correction), and terminates this condition setting. When setting the low humidity development image control, the microcomputer 40 performs processing for correcting γ, which errs due to reduction of the developing bias, on the data of the images to be formed on the sheets 3.

Thus, the developing bias for forming the images on the rear faces of the sheets 3 is set lower than that for forming the images on the front faces in a low-humidity environment exhibiting humidity, detected by the humidity sensor 42, of not more than 20%. Therefore, the developing rollers 24 can be inhibited from excessively feeding the toners to the photosensitive drums 20 when the images are formed on the rear faces of the sheets 3, so that the photosensitive drums 20 can carry excellent toner images. Thus, excellent images can be formed on both faces of the sheets 3 in the manual duplex mode.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. An image forming apparatus comprising:

an image forming section forming an image on an image forming face of a recording medium;

a recording medium feeding section set with the recording medium to be fed to the image forming section;

a recording medium ejecting section receiving the recording medium formed with the image in the image forming section, and having a manual duplex mode for manually setting a recording medium formed with an image on a first image forming face and ejected to the recording medium ejecting section on the recording medium feeding section and forming another image on a second image forming face of the recording medium opposite to the first image forming face;

a processor configured to provide:

a condition setting section for individually setting an operating condition of the image forming section for forming the image on the first image forming face and another operating condition of the image forming section for forming the image on the second image forming face in the manual duplex mode;

a control section for controlling the image forming section on the basis of each of the operating conditions set by the condition setting section; and a humidity detecting unit detecting humidity; wherein the image forming section comprises:

an image carrier carrying a developing agent image corresponding to the image to be formed on the recording medium; and a developing agent feeder supplied with a developing bias for feeding a developing agent to the image carrier, and the condition setting section sets a developing bias for forming the image on the second image forming face lower than a developing bias for forming the image on the first image forming face when the humidity detected by the humidity detecting unit is not higher than a predetermined humidity.

2. The image forming apparatus according to claim 1, wherein the condition setting section individually sets each of the operating conditions on the basis of a thickness of the recording medium.

3. The image forming apparatus according to claim 1, wherein the condition setting section individually sets each of the operating conditions on the basis of a width of the recording medium.

4. The image forming apparatus according to claim 1, further comprising an elapsed time counting section counting an elapsed time from completion of formation of images on the first image forming faces of a prescribed number of recording media up to starting of an operation for forming images on the second image forming faces, wherein the condition setting section sets the operating condition of the image forming section for forming the images on the second image forming faces on the basis of the elapsed time counted by the elapsed time counting section.

5. The image forming apparatus according to claim 4, wherein the image forming section further comprises:

a transfer member supplied with a transferring bias for transferring the developing agent image carried on the image carrier to the image forming face of the recording medium, and the condition setting section comprises:

a first storage section storing a table to be referred to for setting a transferring bias for forming the image on the second image forming face when the elapsed time counted by the elapsed time counting section is less than a predetermined time; and a second storage section storing another table to be referred to for setting a transferring bias for forming the image on the first image forming face and another transferring bias for forming the image on the second image forming face when the elapsed time counted by said elapsed time counting unit is not less than the predetermined time.

6. The image forming apparatus according to claim 1, wherein the condition setting section sets the operating condition of the image forming section for forming the image on the second image forming face on the basis of a frequency of image formation when images are continuously formed on the second image forming faces of a plurality of recording media.

7. The image forming apparatus according to claim 1, wherein the image forming section further comprises:

a transfer member supplied with a transferring bias for transferring the developing agent image carried on the image carrier to the image forming face of the recording medium, the recording medium ejecting section comprises:

a face-up ejecting section to which recording media are ejected while upwardly directing image forming faces thereof formed with images and on which the ejected recording media are successively stacked; and a face-down ejecting section to which recording media are ejected while downwardly directing image forming faces thereof formed with images, and on which the ejected recording media are successively stacked, the recording medium feeding section is capable of accommodating a plurality of recording media in a stacked state, and feeds the stacked recording media toward the image forming section successively from the uppermost one, and the condition setting section sets the transferring bias for forming images on the second image forming faces of the recording media corresponding to whether a plurality of the recording media ejected to the face-up ejecting section are set on the recording medium feeding section and images are successively formed on the second image forming faces of the plurality of recording media, or the plurality of recording media ejected to the face-down ejecting section are set on the recording medium feeding section and images are successively formed on the second image forming faces of the plurality of recording media.

8. The image forming apparatus according to claim 7, wherein the condition setting section sets a lower transferring bias for forming the image on the second image forming face as the number of the image formation on the second image forming face increases when a plurality of the recording media ejected to the face-up ejecting section are set on the recording medium feeding section and images are successively formed on the second image forming faces of the plurality of recording media, and the condition setting section sets a higher transferring bias for forming the image on the second image forming face as the number of the image formation on the second image forming face increases when the plurality of recording media ejected to the face-down ejecting section are set on the recording medium feeding section and images are successively formed on the second image forming faces of the plurality of recording media.

* * * * *